United States Patent [19]

Persson

[11] 3,999,640

[45] Dec. 28, 1976

[54] CORD WINDING STRUCTURE

[75] Inventor: Gunnar Ingemar Persson, Tyreso, Sweden

[73] Assignee: Aktiebolaget Electrolux, Stockholm, Sweden

[22] Filed: Mar. 15, 1976

[21] Appl. No.: 666,636

[30] Foreign Application Priority Data

Mar. 26, 1975 Sweden ..... 7503537

[52] U.S. Cl. ..... 191/12.4; 15/323; 220/334; 312/272.5

[51] Int. Cl.[2] ..... H02G 11/02

[58] Field of Search ..... 191/12.4, 12.2 R; 242/107.2; 49/70; 15/323; 339/119 C; 174/135; 220/262, 263, 264, 334; 312/272.5, 273

[56] References Cited

UNITED STATES PATENTS

| | | | |
|---|---|---|---|
| 914,772 | 3/1909 | Williamson | 191/12.4 |
| 2,877,488 | 3/1959 | Tamarin | 191/12.4 |

*Primary Examiner*—Trygve M. Blix
*Assistant Examiner*—Reinhard J. Eisenzopf
*Attorney, Agent, or Firm*—Alfred E. Miller

[57] ABSTRACT

A cord winder arrangement particularly for a vacuum cleaner or other household appliance in which the vacuum cleaner housing is provided with a section having a closable access door through which the cord and the electrical connection plug passes through when the vacuum cleaner is inoperative, thereby enclosing the electrical cord and its plug entirely within the vacuum cleaner housing. The access door is operated by a foot button that opens the door and, at the same time, projects the plug out of the housing when it is desired to operate the appliance.

8 Claims, 5 Drawing Figures

CORD WINDING STRUCTURE

BACKGROUND OF THE INVENTION

In known cord winding structures for appliances, a part of the free end of the electrical cord and its connection plug are located outside of the casing of the vacuum cleaner or other household appliance when the appliance is not being used. Of course, the plug and its associated cord are always easily accessible, however there is a serious drawback to this known arrangement in that the projecting parts are often in the way when the vacuum cleaner is stored, and additionally the exposed plug and cord can be easily damaged unwittingly.

In order to avoid the above disadvantage a storing pocket for the cord end and its associated plug can be envisioned. However, if such a construction were made it would be necessary to make the internal pocket comparatively large in size since otherwise it will be difficult to insert a hand into the internal pocket for grasping the connection plug.

It is therefore an object of the present invention to provide a cord winding structure and a housing which accommodates the entire cord and connection plug within the housing without requiring a large amount of interior space and at the same time making the connection plug easily accessible.

Another object of the present invention is to provide an arrangement in which a simple manner the movement of the cord during winding is braked. The arrangement includes a follower plate in the interior space which is operatively connected to a foot-operated push button that moves the connection plug from the space inside the housing to a position outside of the housing in which the plug is easily accessible when the push button is actuated.

In order that the invention will be more clearly understood, it will now be disclosed in greater detail with reference to the accompanying drawings, in which.

Figure 1:
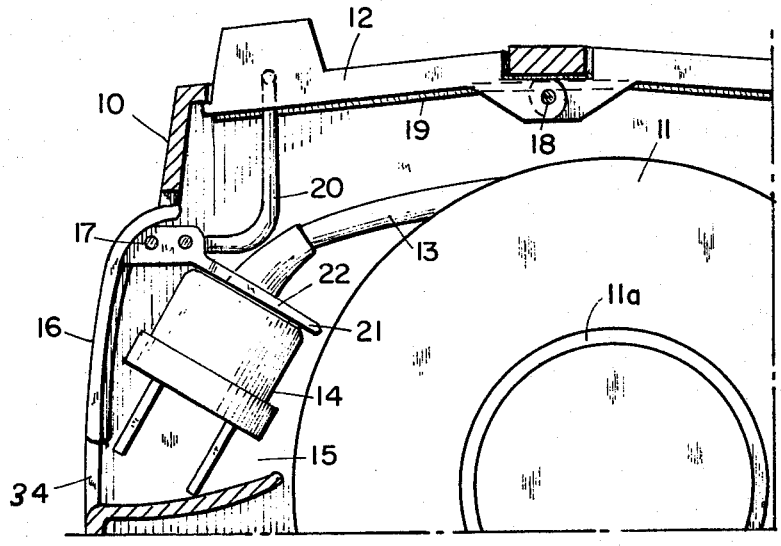
FIG. 1 is a sectional view through a part of a vacuum cleaner housing showing the details of construction of the present invention and with the electrical cord and the connection end plug in place internally within the vacuum cleaner housing.
Figure 2:
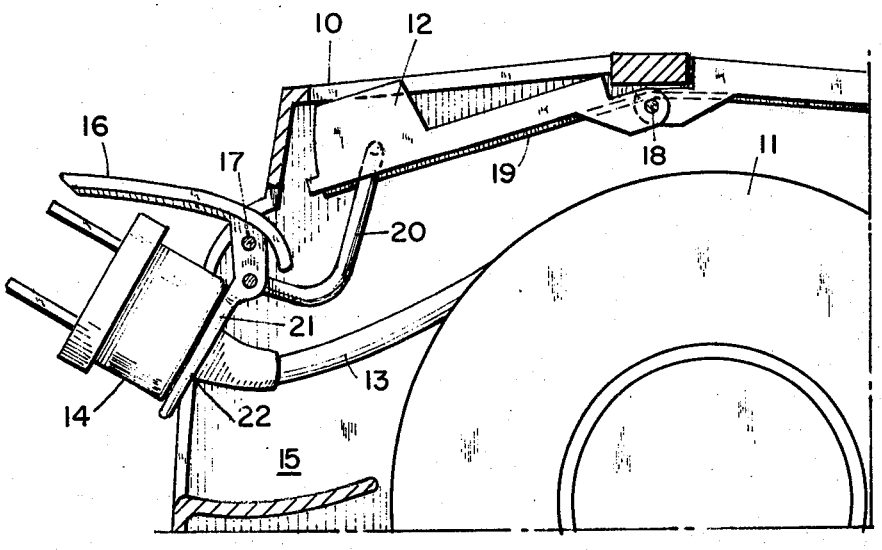
FIG. 2 is a sectional view, similar to the view shown in FIG. 1, but with the plug projecting out of the housing and accessible for use.

As seen in FIGS. 1 and 2, a part of a vacuum cleaner housing 10 is shown which includes the usual motor fan and removable dust container (not shown). The housing also encloses a cord winder 11. The winder comprises a rotatable reel 11*a* on which the electric cord is wound. Furthermore, the reel is spring-loaded and can be braked so that the cord when pulled out remains in the selected pulled out position, and when the brake is released by depression of a push button 12 projecting out of the housing 10 is wound back on the reel. An electrical connection plug 14 is physically and electrically connected to the outer end 13 of the cord.

When the cord is wound on the reel, the connection plug 14 is maintained in an internal space 15 of the housing having an opening covered by a lid or door 16. The lid is pivotally supported on a shaft 17 and is operated by the push button 12, which in turn is pivotally supported on a shaft 18, the latter being influenced by a spring 19. As seen in the Figures, the spring 19 comprises a bent wire resting on the shaft 18 while urging the push button 12 in an upward direction. However, any type of spring can be used for the purpose described hereinabove. The push button 12 is shown connected to the lid 16 by an L-shaped link arm 20 so that the lid opens when the push button is depressed. The lid 16 further supports a follower plate 21 having a hole 22 through which the cord passes. It will be noted that the hole 22 is smaller in diameter than the diameter of the connection plug so that the plug 14 is stopped by the follower plate from further movement when the cord is being rewound on the reel 11*a*.

The operation of the present cord winder is as follows:

When the push button 12 is depressed the arm 20 acts on the lid 16 causing it to turn clockwise about the shaft 17. In addition, the follower plate 21 turns and moves the connection plug 14 out of the housing, as seen in FIG. 1 to the position shown in FIG. 2, so that it becomes accessible for pulling out the cord to the extent desired.

When the cord is to be rewound, the push button 12 is again depressed and the brake (not shown) releases the cord reel at the same time as the lid opens and the follower plate moves forward to a position in which it engages the electrical connection plug 14. When the cord has been wound on the reel the push button is released which causes the lid to close, and at the same time the electrical connection plug passes inside the housing 10.

It should be noted that the lid 16 does not cover the entire opening, but a gap 34 is left between the lower part of the lid and the vacuum cleaner housing 10. Thus, the cord will not get stuck in the gap when being pulled out.

Figure 3:
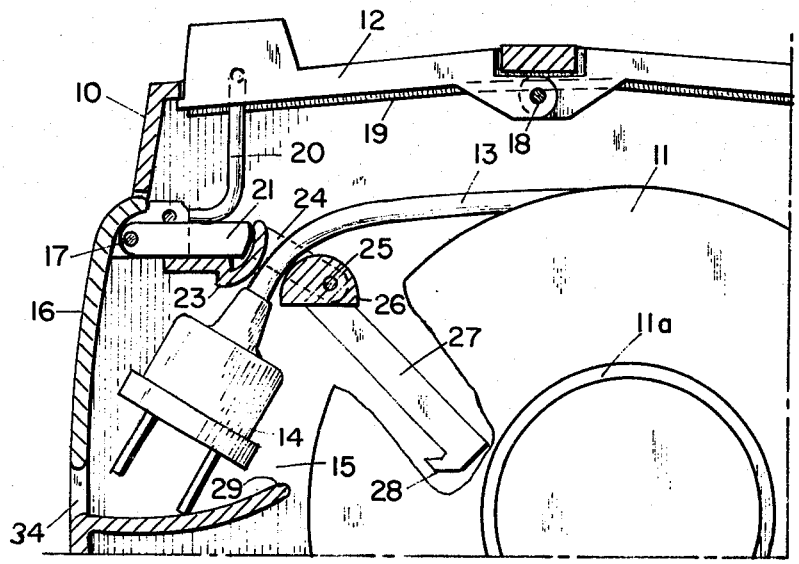
FIG. 3 is a sectional view through a part of a vacuum cleaner housing similar to that shown in FIG. 1 but illustrating the device being provided with a brake for electrical cord that is positioned within the housing together with the connection end plug.
Figure 4:
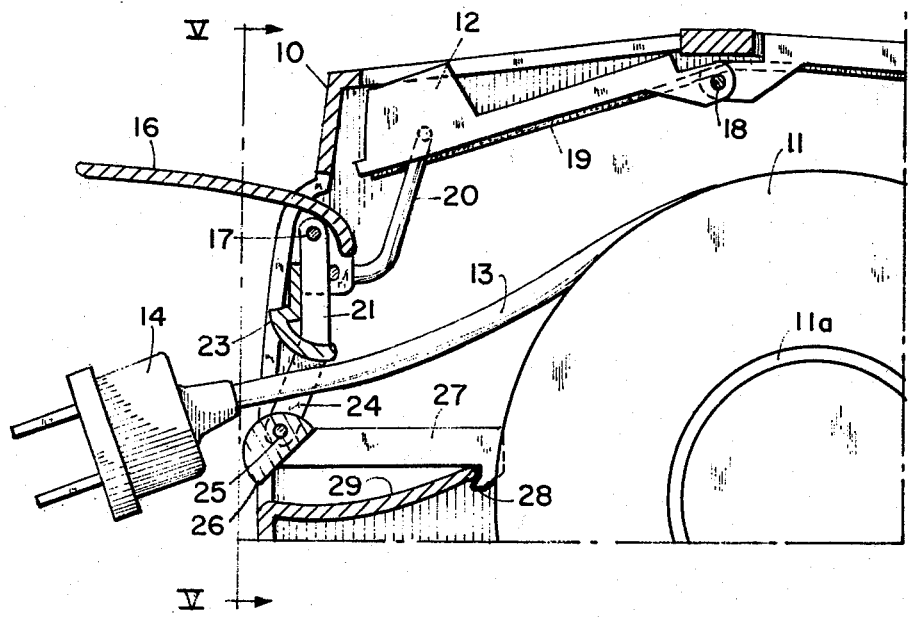
FIG. 4 is a sectional view similar to FIG. 3 but showing the connection plug projected outside of the housing and easily accessible.
Figure 5:
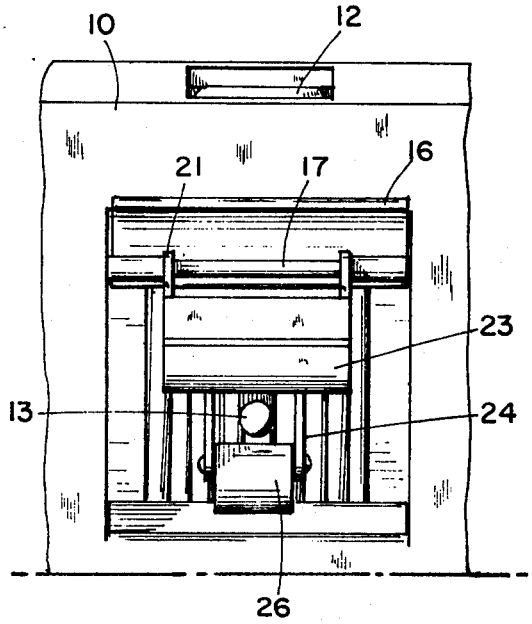
FIG. 5 is a sectional view taken along the lines V—V of FIG. 4 showing the electrical cord and guide arms therefor.

Referring now to FIGS. 3 and 4, a brake working on the cord is shown. This brake is formed by the follower plate 21 and parts associated therewith. Thus, the follower plate 21 has a stationary part 23 with a cylindrical surface from which project parallel arms 24 that are spaced a distance from one another. It will be observed that for the purpose of clarity, only one arm is shown in FIGS. 3 and 4. The free end of the arms 24 are interconnected by a shaft 25 supporting a rotatable part 26, which is in the half-cylindrical form. The rotatable part 26 is shown mounted eccentrically and is provided with an arm 27 by which the part 26 is turnable. The outer free end of the arm 27 has a hook 28 which under certain conditions engages with a projecting part 29 of the vacuum cleaner housing. The stationary part 23 and the rotatable part 26, with the arms 24 associated therewith, form a guide surrounding the cord. The rotatable part is supported in such a way that the distance between the stationary part and the rotatable part varies depending upon the position of the rotatable part. Thus, the cord can either be caused to run freely through the opening formed between these parts, or is locked, when the distance between the parts decreases to a certain value.

The brake mechanism shown in FIGS. 3 and 4 operates in the following manner: The electrical cord is pulled out as described in connection with the embodiment of FIGS. 1 and 2. Thus, the depression of the push button 12 causes the lid 16 to open, and the follower plate 21 urges the connection plug 14 out of the casing. During this movement the hook 28 abuts the projecting part 29 of the vacuum cleaner and is engaged by it. The arm 27 then turns counterclockwise about the shaft 25 so that the distance between the stationary part 23 and the rotatable part 26 increases and the cord can be pulled out between the stationary and the rotatable parts. When the cord is released the follower plate rebounds under the action of the spring 19 and the arm 27 turns clockwise about the shaft 25 and clamps the cord between the stationary part 23 and the rotatable part 26 as seen in FIG. 3. To force the rotatable part to turn clockwise in all positions, another spring (not shown) can be provided, for instance about the shaft 25, so that the spring acts between the follower plate 21 and the arm 27. The push button 12 is depressed in order to rewind the cord which thus causes the cord to be released and the lid to move to an open position. The rewinding of the cord can now be braked by releasing the push button 12 at suitable time intervals. When the connection plug 14 reaches the follower plate, the latter is then entrained in the space 15 and, if simultaneously the push button 12 is released, the lid 16 closes.

What is claimed is:

1. A cord winding structure for a vacuum cleaner or other household appliance comprising a housing having a cord winder mechanism therein, the free end of the electrical cord having a connection plug for insertion in an electrical outlet, a free space in said housing adjacent to said cord winder mechanism capable of receiving and storing the connection plug and that portion of the electrical cord connected therewith and adjacent thereto, a foot or manual operator projecting from said housing, and a follower plate operatively connected to said operator and arranged to move said connection plug from said space inside said housing to a position at least partially outside of said housing when said operator is actuated thereby making said plug easily accessible.

2. The cord winding structure as claimed in claim 1 wherein said space has an opening, a pivotable lid at least partly covering said opening when said cord is wound on said reel, and means linking said operator and said follower plate which opens said lid when said operator is actuated.

3. The cord winding structure as claimed in claim 2 wherein said operator is push button that is operated externally of said housing.

4. The cord winding structure as claimed in claim 2 wherein linking means is an L-shaped arm.

5. The cord winding structure as claimed in claim 2 further comprising a brake device for said cord being connected to said lid.

6. The cord winding structure as claimed in claim 5 wherein said brake device is provided with one part that is stationary relative to said lid and another spaced part which is eccentric and rotatable relative to said lid, said cord passing through said space between said parts.

7. The cord winding structure as claimed in claim 6 further comprising a swingable arm having one end pivotally attached to said rotatable part, the other end of said swingable arm being provided with a hook which adapted to engage a portion of said housing when said brake device is inoperative.

8. The cord winding structure as claimed in claim 7 further comprising a shaft mounting said rotatable part, and two spaced arms projecting from said stationary part, said shaft extending between said two arms and together with said stationary part and said rotatable part forms a guide surrounding said cord.

* * * * *